US006499247B1

(12) United States Patent
Peterson

(10) Patent No.: US 6,499,247 B1
(45) Date of Patent: Dec. 31, 2002

(54) LASER BORE-SIGHT SCOPE AND MOUNT FOR RIFFLES

(75) Inventor: Thomas K. M. Peterson, Courtland, MN (US)

(73) Assignee: Stoney Point Products, Inc., New Ulm, MN (US)

( * ) Notice: Subject to any disclaimer, the term of this patent is extended or adjusted under 35 U.S.C. 154(b) by 0 days.

(21) Appl. No.: 09/917,560

(22) Filed: Jul. 27, 2001

(51) Int. Cl.[7] ..... F41G 1/00
(52) U.S. Cl. ..... 42/116
(58) Field of Search ..... 42/116, 111, 113, 42/114, 115, 119, 122, 130, 103, 117, 120, 121, 134; 33/228, 286, 234; 362/111; 73/167

(56) References Cited

U.S. PATENT DOCUMENTS 3,711,204 A * 1/1973 Steck, III ..... 356/153
3,782,832 A * 1/1974 Hacskaylo ..... 356/153
4,530,162 A * 7/1985 Forrest et al. ..... 33/228
5,031,349 A * 7/1991 Vogel ..... 73/167
5,040,885 A * 8/1991 Simms ..... 350/537
5,233,124 A 8/1993 Peterson
5,454,168 A 10/1995 Langner
5,499,455 A * 3/1996 Palmer ..... 33/233
5,813,131 A * 9/1998 Werre ..... 33/645
5,878,504 A 3/1999 Harms

FOREIGN PATENT DOCUMENTS

CH 667150 A * 3/1984

* cited by examiner

*Primary Examiner*—Charles T. Jordan
*Assistant Examiner*—Jordan Lofdahl
(74) *Attorney, Agent, or Firm*—Haugen Law Firm PLLP

(57) ABSTRACT

A method of adjustably positioning and attaching mounting rings to a firearm for subsequent attachment of an optical gun sight (telescopic sight) within the rings. Two separate beams of coherent or monochromatic light are utilized, both of which are directed onto a remote target. The first beam is created from a bore sighting assembly which directs its beam through the bore of the firearm. The second beam originates from a hollow cylindrical light source mounted within the rings, the outer diameter of the hollow cylinder being designed to mate within the actual mounting rings which are being positioned. With both beams simultaneously impinging upon the remote target, the user may then positionably adjust the rings retaining the second source of coherent light so that the user, with data on the ballistics of the ammunition to be used, may accurately pre-adjust the mounting rings on the firearm prior to mounting the scope within the mounting rings.

5 Claims, 2 Drawing Sheets

LASER BORE-SIGHT SCOPE AND MOUNT FOR RIFFLES

BACKGROUND OF THE INVENTION

The present invention relates generally to an improved method for adjustably positioning and attaching the mounting rings onto a firearm for ultimate attachment of an optical gun sight such as a telescopic sight (scope) to the rings. The method of the present invention employs dual sources and beams of coherent light wherein one of the sources is positionably mounted within the mounting rings into which the optical gun sight is to be placed, and its beam is directed onto a remote target. This coherent light source is utilized in combination with a second coherent light source, the beam of which passes axially through the bore of the firearm and onto the same remote target. Briefly, coherent light from the two sources are directed onto the same remote target, and the disposition of the light emanating from the source within the mounting rings is used to achieve proper placement of the rings on the body of the firearm.

Optical gun sights, typically telescopic gun sights are in common use on all types of firearms, and more particularly on rifles. In operation, the telescopic sight is typically mounted upon the rifle using bench-style equipment, and as such, internal adjustment of the scope is required for the long range accuracy. Telescopic sights are typically equipped with means for adjustably positioning the reticules. For example, a single line or group of intersecting fine lines comprise the reticules which are positioned within the focus of the objective lens of the scope. Whenever significant adjustment is made of the reticule components, with either the horizontal (elevation) or vertical (windage) lines forming the complete reticule, accuracy is ultimately compromised. Extensive internal adjustments of the internal components of the optical sight normally introduce parallax in the scope or sight. The operations involved in commercial production of firearms, particularly rifles, necessarily involves the manufacture of components within a certain range of tolerances. As a result, such tolerances ultimately affect accuracy. Even when components are produced within the specified manufacturing tolerances, shooting accuracy may be significantly adversely affected. As a result, optical sights including scopes are designed with internal features to accommodate adjustment for enhancing accuracy in performance. However, when it becomes necessary to overly compensate or significantly adjust optical sights through their internal mechanisms, the performance of the scope itself is adversely affected. Primarily, the parallax which is created during the adjustment operation is an undesirable but virtually inevitable consequence. By providing for accurate positioning of the mounting rings and the scope during the installation operation, the need for any significant or substantial internal adjustment is virtually eliminated, with the result being that internal adjustments are held and maintained at a practical minimum.

SUMMARY OF THE INVENTION

In accordance with the present invention, a system is devised wherein the mounting rings for the scope or sight are adjustably positioned with a reasonably high degree of accuracy prior to the time the telescopic sight is actually mounted and/or received within the mounting rings. In order to accomplish the steps of the method, a coherent light source retainer device is positioned and received within adjustably positionable mounting rings which will ultimately receive the optical gun sight. A source of coherent light is positioned within the light source retainer, and accordingly maintained in axial alignment with the mounting rings. At the same time, a bore sighting assembly is coupled to the firearm from which a coherent beam of monochromatic light is passed axially through the firearm bore and onto a remote target. With both beams of coherent light being displayed on a remote target, the mounting rings are adjustably positioned so as to be securely held in place so that the alignment axis of the mounting rings lies within a plane extending parallel to the axis of the firearm bore. In other words, the position or location of the first and second coherent light beams on the remote target permit and facilitate positionable adjustment of the mounting rings until the axes of the first and second coherent light beams are parallel, so as to be arranged along a common vertical plane. As a result, the mounting rings may be accurately positioned on the firearm prior to the final or ultimate attachment of the telescopic sight within the rings, thereby significantly reducing the magnitude or extent of any final adjustment necessarily undertaken by the user for ultimate accuracy.

Therefore, in accordance with the present invention, a method is provided for accurately pre-positioning and attaching the mounting rings for a telescopic gun sight onto a firearm prior to actual placement of the s cope in the rings. In conducting the steps of the method, a pair of coherent light beams are passed from the firearm onto a remote target, with the first coherent light beam being passed axially through the firearm bore, and with the second beam passing through the common axis of spaced mounting rings and onto the same remote target. Thus, rather than being in relatively coarse adjustment, these rings are positionably adjusted and locked into place with a relatively high degree of precision prior to receiving the scope device. The simultaneous display of coherent light beams onto the remote target, one emanating from a source passing through the axis of the firearm bore, the other passing through the axis of the spaced mounting rings provides a sound basis for reasonably precise adjustment of the mounts prior to final attachment of the telescopic sight.

Therefore, it is a primary object of the present invention to provide an improved method for adjustably positioning and attaching the mounting rings for an optical gun sight upon a firearm, with the method permitting the reasonably precise placement of the mounting rings prior to actual attachment of the gun sight.

It is a further object of the present invention to provide an improved method for pre-positioning telescopic sight mounting rings onto a firearm prior to physical attachment of the telescopic gun sight so as to reduce to a minimum the degree of internal adjustment necessary to accurately sight-in the firearm.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
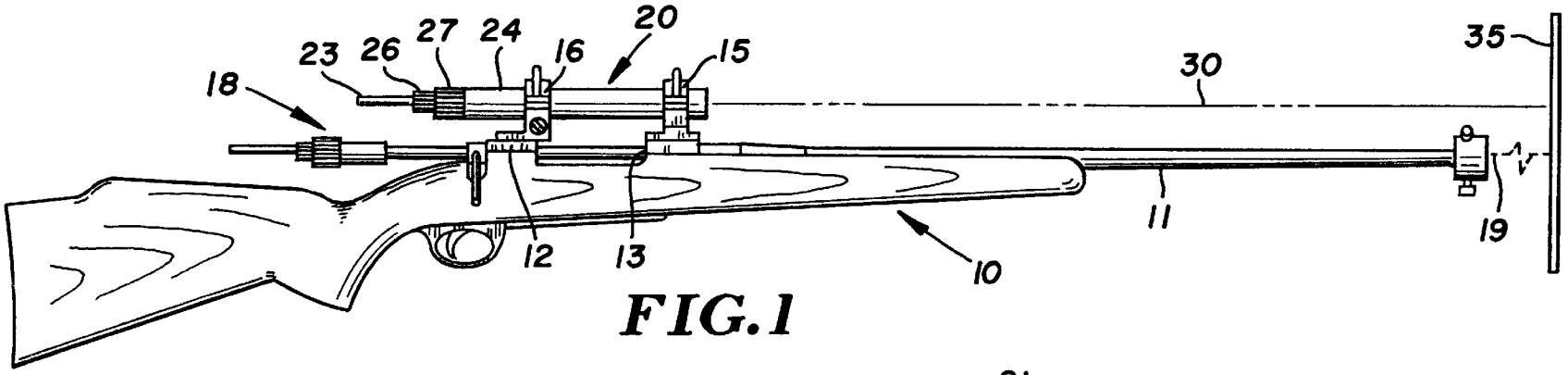
FIG. 1 is a side elevational view of a rifle equipped with the coherent light beam generators and illustrating, schematically, the simultaneous delivery of coherent beams of monochromatic light from the sources onto a remote target.
Figure 2:
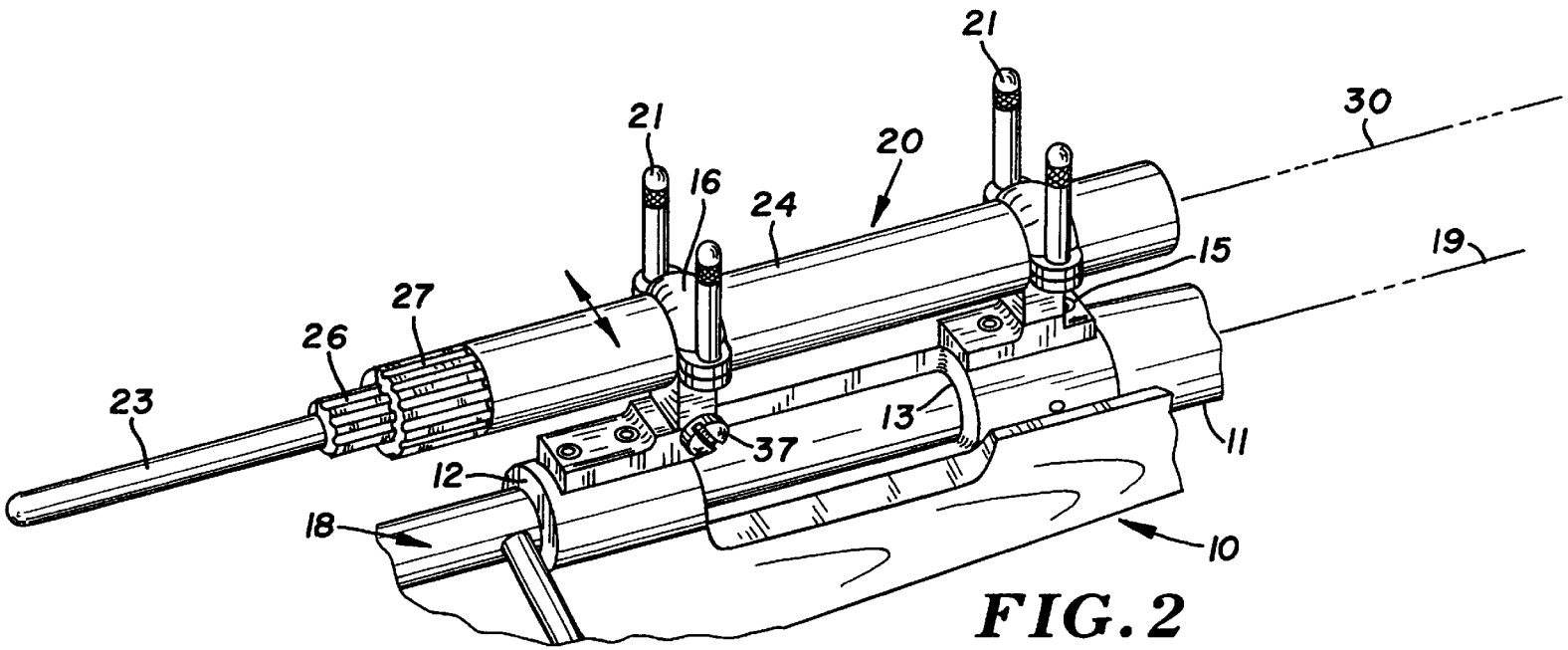
FIG. 2 is a fragmentary perspective view on an enlarged scale of the firearm as illustrated in FIG. 1, and showing the detail of the attachment of the two coherent light beam generators onto the firearm including the attachment and disposition of the spaced scope mounting rings.
Figure 5:
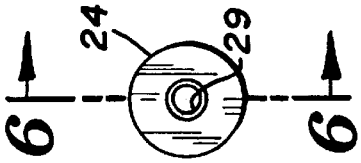
FIGS. 4 and 5 are rear elevational and front elevational views respectively of the assembly illustrated in FIG. 3.

In accordance with the preferred method of the present invention, an exemplary firearm is illustrated in FIG. 1, with the attachments necessary to carry out the steps of the present invention being secured in place onto the firearm. Accordingly, the firearm generally designated 10 includes barrel 11 with a receiver 12 and a breech 13 as illustrated in FIGS. 1 and 2. Scope mounting rings including front mounts 15 and rear mounts 16 are in place on the firearm, being attached to barrel 11 particularly in the receiver area 12 (FIG. 2). Rings 15 and 16 are, of course, in axial alignment, with these rings ideally being in coaxial alignment, one with the other. Barrel 11 has a conventional bore (not shown) through which projectiles such as conventional bullets travel upon firing. The axis of the firearm bore lies in a vertical plane through which the axis of mounting rings 15 and 16 passes.

With attention now being directed to FIG. 2 of the drawings, a bore sighting assembly such as shown generally at 18 is in place within the firearm 10, and specifically within the receiver area 12. Bore sight 18 is shown in detail in my copending application Ser. No. 09/373,297, filed Aug. 12, 1999, entitled "LASER BEAM APPARATUS FOR ADJUSTING TELESCOPIC GUN SIGHTS". As indicated in FIGS. 1 and 2, the light beam 19 from laser bore sight device 18 exits the firearm bore as illustrated schematically at 19.

Figure 8:
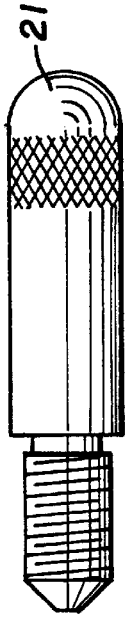
FIG. 8 is an elevational view of temporary hold-down screws utilized to retain the laser generator housing illustrated in FIG. 3 within the mounting rings, as illustrated in FIG. 2.

With continued attention being directed to FIGS. 1 and 2, hollow cylindrical coherent light source retainer means generally designated 20 is shown held within mounting rings 15 and 16. Temporary screws such as shown at 21—21 are utilized for this purpose (see FIG. 8). It is a feature of the present invention that the outer diameter of housing 24 be consistent with and match the standard and accepted outer diameter of telescopic sights in use in this country. The standard tube diameter for scope bodies manufactured in the United States is 1.0". In those instances where the scope is to be mounted has a different dimension, the outer diameter of laser housing 24 will be modified to match the outer diameter of the scope body to be received in the mounts.

Figure 7:
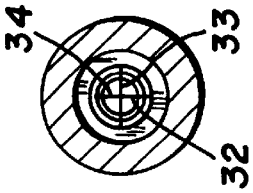
FIG. 7 is a sectional view taken along the line and in the direction of the arrows 7—7 of FIG. 6.
Figure 3:
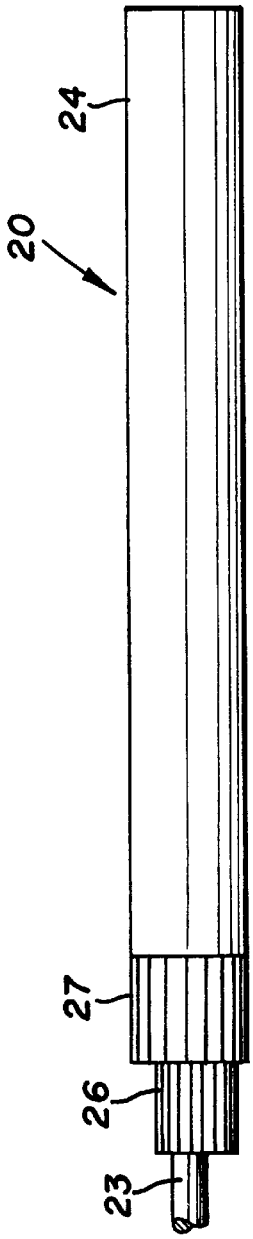
FIG. 3 is a detail elevational view of the beam generator housing (laser housing) adapted to retain the beam generators while being positioned in the mounting rings.
Figure 4:
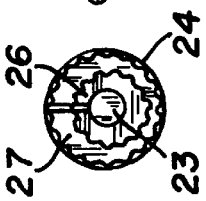
Figure 6:
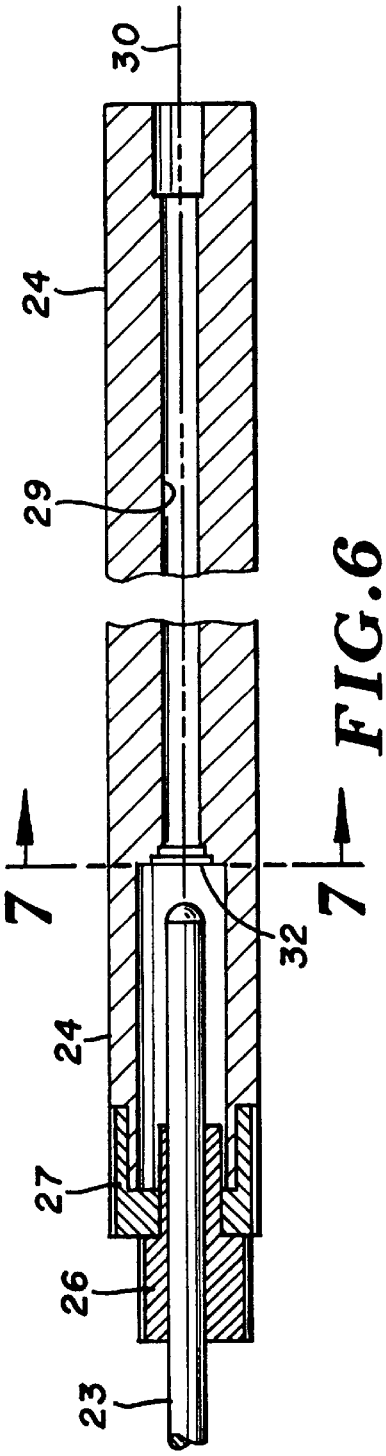
FIG. 6 is a sectional view taken along the line and in the direction of the arrows 6—6 of FIG. 5.

Coherent light source retainer means 20 includes laser housing 24 having a hollow core as illustrated in FIG. 6. Laser generator 23 is held in place within housing 24 by means of dual eccentric mounting rings 26 and 27. Laser generator 23 is conventional, being cylindrical in configuration, and being commercially available from a variety of sources. The beam 30 from laser generator 23, which, as indicated is a coherent beam of monochromatic light, passes from generator 23 through bore 29 formed in housing 24, exiting, as shown in FIGS. 1, 2 and 6). In the path of beam 30 and within the proximal end of housing 24, a cross-hair reticule is mounted as shown at 32. Reticule 32, as illustrated in FIG. 7, is provided with fixed horizontal (elevation) and vertical (windage) lines 33 and 34 respectively. In order to provide for coaxial alignment between beam 30 and bore 29, eccentric mounting rings 26 and 27 are positionably adjusted so as to retain beam generator 23 in proper disposition within housing 24.

In carrying out the steps of the present invention, laser beam generator from bore sight device 18 is positioned so as to deliver a beam coaxially through the firearm bore, as at 19. At the same time, coherent light energy from source 23 is caused to pass as beam 30 through housing bore 29 and onto remote target 35. Reticule 32 creates an image on the surface of target 35 immediately above and adjacent the image created by coherent light beam 19. Vertical alignment of beams 19 and 30 will enable the technician to properly positionably adjust mounting rings 15 and 16 on rifle 10 prior to actual attachment of the scope. Of particular interest is windage adjustment screw 37 which is traditionally a component of rear-mount as shown at 16. The double-arrow (FIG. 2) illustrates the motion path created by movement of windage adjustment screw 37. Thus, with housing 24 clamped within rings 15 and 16 by temporary mounting screws 21—21, the impingement of beam 30 onto the remote target can be used to properly position rear mounting ring 16 on rifle 10.

It will be appreciated that various modifications may be prepared utilizing the techniques of the present invention, it being further understood that the examples given herein are for purposes of illustration only and are not to be construed as a limitation upon the scope to which the invention is otherwise entitled.

What is claimed is:

1. In the method of adjustably positioning and attaching coaxially spaced mounting rings in axial alignment on a firearm for attachment of an optical gun sight coaxially within said mounting rings, the firearm having a receiver and a barrel and with the barrel comprising a firearm bore with a breech at one end and a muzzle at the opposed end, said method comprising:

(a) coupling a bore sighting assembly onto said firearm at said breech end for directing a coherent beam of monochromatic light axially through said firearm bore and onto a remote target;

(b) mounting a hollow cylindrical coherent light source retainer means within said mounting rings;

(c) positioning a second source of coherent light within the hollow core of said coherent light source retainer means with said second source of coherent light being retained within a light source retaining housing of cylindrical configuration, and with the beam of coherent light from said second source being emitted coaxially with the axis of said hollow core;

(d) said second coherent light source retainer means including dual eccentric sleeve means telescopically received within said hollow core, and with the axes of said dual eccentric sleeve means being disposed parallelly to the axis of said hollow core;

(e) directing said first and second coherent light beams onto said remote target; and (f) positionably adjusting said gun sight mounting means upon said firearm until the axes of said first and second coherent light beams are arranged along a common vertical plane.

2. The method of claim 1 including the step of interposing a reticule coaxially within the hollow core of said coherent light source retainer means to intercept said second coherent light beam and cast its shadow upon said remote target.

3. The method of claim 1 including the step of centering said second coherent light beam source within the hollow core of said coherent light source retainer means.

4. The method of claim 1 wherein the external walls of said hollow core coherent light source retainer replicates those of the optical gun sight to be attached within said mounting rings.

5. The method of claim 3 including the step of mounting said second coherent light beam source within telescopically engaged first and second eccentric mounting cylinders.

* * * * *